US006289775B1

(12) United States Patent
Wei

(10) Patent No.: US 6,289,775 B1
(45) Date of Patent: Sep. 18, 2001

(54) SCREW DRIVER WITH FOUR FAN-SHAPED BLADES

(76) Inventor: Lin Chao Wei, 16F-1, No. 179, Chang-Jung Rd., Sec. 1, Tainan City (TW)

( * ) Notice: Subject to any disclaimer, the term of this patent is extended or adjusted under 35 U.S.C. 154(b) by 0 days.

(21) Appl. No.: 09/638,682

(22) Filed: Aug. 14, 2000

Related U.S. Application Data

(63) Continuation-in-part of application No. 09/373,021, filed on Aug. 11, 1999, now abandoned, which is a continuation-in-part of application No. 09/193,489, filed on Nov. 17, 1998, now abandoned.

(51) Int. Cl.[7] ..... B25B 23/00
(52) U.S. Cl. ..... 81/460; 81/436
(58) Field of Search ..... 81/436, 460, 438; D8/82

(56) References Cited

U.S. PATENT DOCUMENTS 4,998,454 * 3/1991 Chaconas et al. ..... 81/460

FOREIGN PATENT DOCUMENTS

1562074 * 4/1969 (IT) ..... 81/460

* cited by examiner

*Primary Examiner*—Joseph J. Hail, III
*Assistant Examiner*—Joni B. Danganan
(74) *Attorney, Agent, or Firm*—Bacon & Thomas, PLLC

(57) ABSTRACT

A screw driver exclusively applied to drive a particular screw having compound drive recesses that can be driven by various conventional drivers, i.e., slot, cross, square-cross, square, and double-cross. The screw driver enables its drive bit to supply sufficiently large driving torques to the compound drive recesses of the screw and the screw driver lodges securely within the compound drive recesses of the screw as the drive bit of the driver turns.

2 Claims, 7 Drawing Sheets

SCREW DRIVER WITH FOUR FAN-SHAPED BLADES

CROSS-RELATED INVENTIONS

This invention is a continuation-in-part of U.S. patent application Ser. No. 09/373,021, filed Aug. 11, 1999, now abandoned, which is a continuation-in-part of U.S. patent application Ser. No. 09/193,489, filed Nov. 17, 1998, now abandoned.

BACKGROUND OF THE INVENTION

1. Field of the Invention

This invention pertains to a screw driver exclusively applied to drive a specialized screw having compound drive recesses as shown in FIG. 20 of U.S. patent application Ser. No. 09/193,489, whereby a screw can be driven by various conventional drivers, i.e. slot, Phillips (cross), square-cross, square, and double-cross recesses, particularly to the screw driver with a drive bit provided with four fan-shaped blades symmetrically disposed with respect to each other, between every two neighboring fan-shaped blades and has an elongated rectangular hollow indented space, a square blunt bottom protrusion formed and situated at the center section of the free end of the drive bitjoining the four fan-shaped blades and the four hollow indented spaces.

2. Description of the Related Art

Conventional fastener drive recess types include slot recess (A) shown in FIG. 1, cross recess (B) shown in FIG. 2, cross-square combination recess (C) shown in FIG. 3, square recess (D) shown in FIG. 4, and double-cross recess (as available under the trademark POZI) (E) shown in FIG. 5. Drive recess structures of aforementioned types generally cannot stand comparatively large torque due to their structural weaknesses and uneven pressure distribution. Typically, if a screw resists turning, then upon applying an increased torque to the driver bit, it slips upwardly out of the drive recess. The more frequent this slippage occurs, worse damage is imposed on both the drive recess and the drive bit. Loose engagement (the drive bit wobbles excessively within the drive recess) is one of the major aspects to consider when both the drive recess and the drive bit fail to withstand a large driving torque.

Five kinds of screw driver bits are shown respectively in FIGS. 6, 8, 10, 12 and 14. In FIG. 6 a slot drive bit is designed to drive recess A (as shown in FIG. 1), and FIG. 7 shows how the slot drive bit is engaged in the compound drive recess. On the sample principle, in FIG. 8 a Phillips drive bit which corresponds to recess B (FIG. 2) engages within the compound drive recess as shown in FIG. 9. In FIG. 10 a cross-square drive bit which corresponds to recess C (FIG. 3) engages within the compound drive recess as shown in FIG. 11. In FIG. 12 a square drive bit which corresponds to recess D (FIG. 4) engages within the compound drive recess as shown in FIG. 13. In FIG. 14 a double-cross recess (as available under the trademark POZI) drive bit which corresponds to recess E (FIG. 5) engages within the compound drive recess as shown in FIG. 15.

Although the screw driver bits, as shown in FIGS. 6–13, are capable of driving the aforementioned compound drive recess, they all fall short of being adequate to either maintain a best possible retention between the drive bit and the drive recess, or supply the maximum driving torque to the aforementioned compound drive recess. Hence, a specific screw drive bit with four fan-shaped blades for the aforementioned compound drive recess is devised to achieve their maximum performance.

Next, the screw drivers disclosed in U.S. Pat. Nos. 2,764,197 and 3,913,647 are specifically designed to fit in recess B (as shown in FIG. 2 of U.S. Pat. No. 2,764,197) but not for the aforementioned compound drive recess; therefore, the maximum driving torques the above two screw drivers can supply will be less than this present invention when they are applied with the aforementioned compound drive recess.

SUMMARY OF THE INVENTION

The objective of the present invention is to offer a screw driver to fit in a particular compound drive recess which can be driven by several conventional drive bits (i.e. slot, cross, square-cross, square-cross, double-cross). With this invention, the aforementioned compound drive recess will be able to stand its maximum limit of driving torque supplied by the inventive driver. Further, the inventive driver is highly stable when retained within the drive recess to assure a smooth screw driving process.

The physical feature of this invention includes four fan-shaped blades symmetrically positioned with respect to each other, between every two adjacent ones of the fan-shaped blades include an elongated rectangular hollow indented space, and a square blunt protrusion is formed and situated in the common lower center section joining the four fan-shaped blades and the four hollow indented spaces.

The screw driver with a drive bit of the present invention has been found to be capable to lodge securely in the drive recess once the drive bit turns. Also, the four fan-shaped blades provide a complete and stable retention superior to conventional screw drive bits (i.e. shown FIGS. 6, 8, 10, 12 and 14.)

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
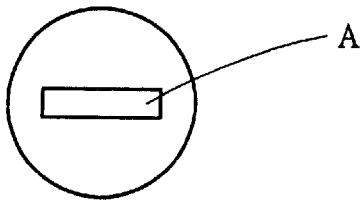
FIG 1 (PRIOR ART)
FIG. 1 is an upper view of a first conventional slot drive recess of a screw.
Figure 2:
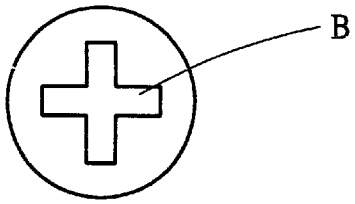
FIG 2 (PRIOR ART)
FIG. 2 is an upper view of a second conventional cross (Phillips) drive recess of a screw.
Figure 3:
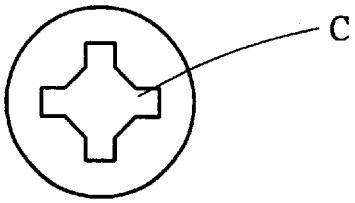
FIG 3 (PRIOR ART)
FIG. 3 is an upper view of a third conventional cross-square drive recess of a screw.
Figure 4:
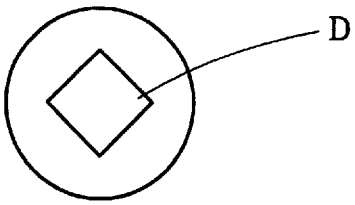
FIG 4 (PRIOR ART)
FIG. 4 is an upper view of a fourth conventional square drive recess of a screw.
Figure 5:
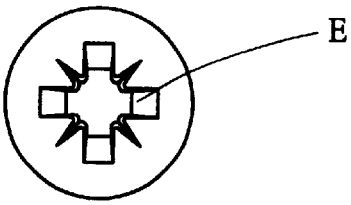
FIG 5 (PRIOR ART)
FIG. 5 is an upper view of a fifth conventional double-cross (as available under the trademark POZI) drive recess of a screw.
Figure 6:
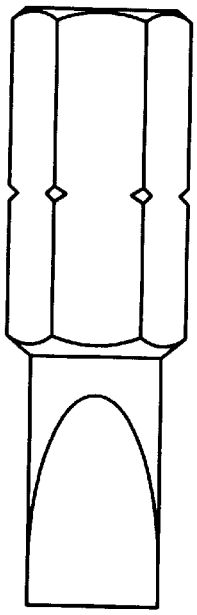
FIG 6 (PRIOR ART)
FIG. 6 is a side view of a screw driver with the first conventional slot drive recess.
Figure 12:
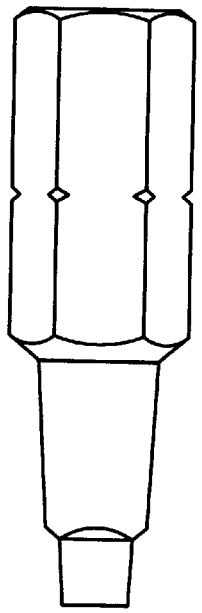
FIG 12 (PRIOR ART)
FIG. 12 is a side view of a screw driver with the fourth conventional square drive recess.
Figure 7:
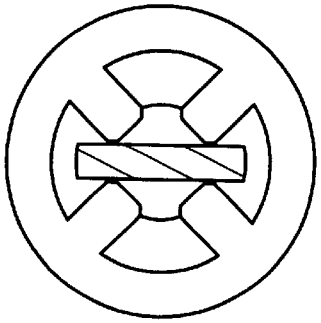
FIG 7 (PRIOR ART)
FIG. 7 is a screw driver of FIG. 6 engaged within the compound drive recess of a screw.
Figure 13:
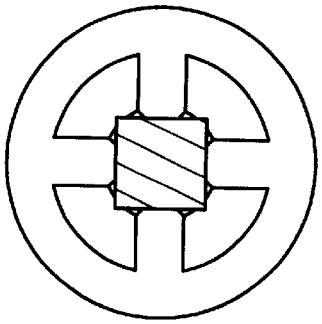
FIG 13 (PRIOR ART)
FIG. 13 is a screw driven of FIG. 12 engaged within the compound drive recess of a screw.
Figure 8:
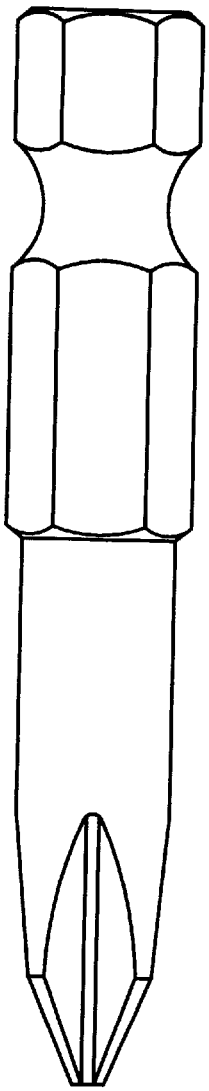
FIG 8 (PRIOR ART)
FIG. 8 is a side view of a screw driver with the second conventional cross (Phillips) drive recess.
Figure 9:
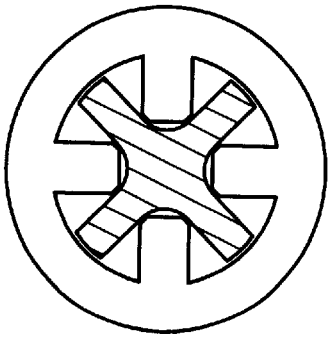
FIG 9 (PRIOR ART)
FIG. 9 is a screw driver of FIG. 8 engaged within the compound drive recess of a screw.
Figure 10:
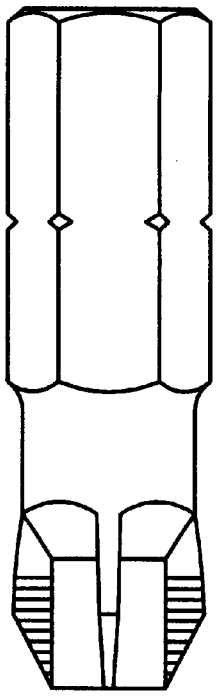
FIG 10 (PRIOR ART)
FIG. 10 is a side view of a screw driver with the third conventional cross-square drive recess.
Figure 11:
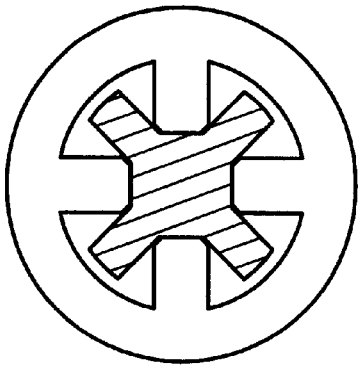
FIG 11 (PRIOR ART)
FIG. 11 is a screw driver of FIG. 10 engaged within the compound drive recess of a screw.
Figure 14:
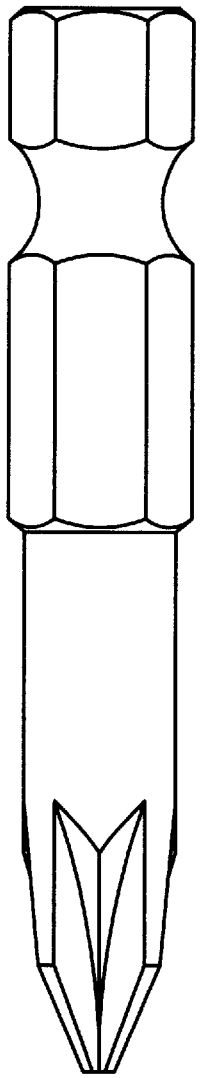
FIG 14 (PRIOR ART)
FIG. 14 is a side view of a screw driver with the fifth conventional double-cross (as available under the trademark POZI) driver recess.
Figure 15:
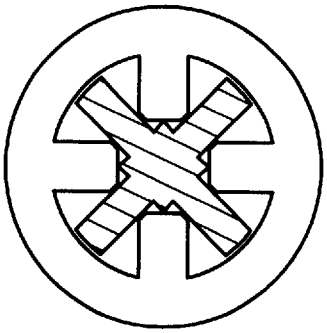
FIG 15 (PRIOR ART)
FIG. 15 is a screw driver of FIG. 14 engaged within the compound drive recess of a screw.
Figure 16:
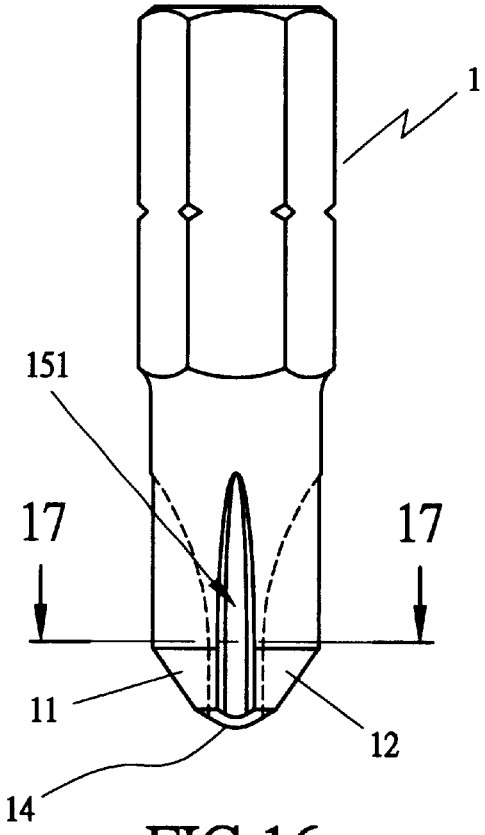
FIG. 16 is a side view of a first embodiment of a screw driver bit in the present invention.
Figure 18:
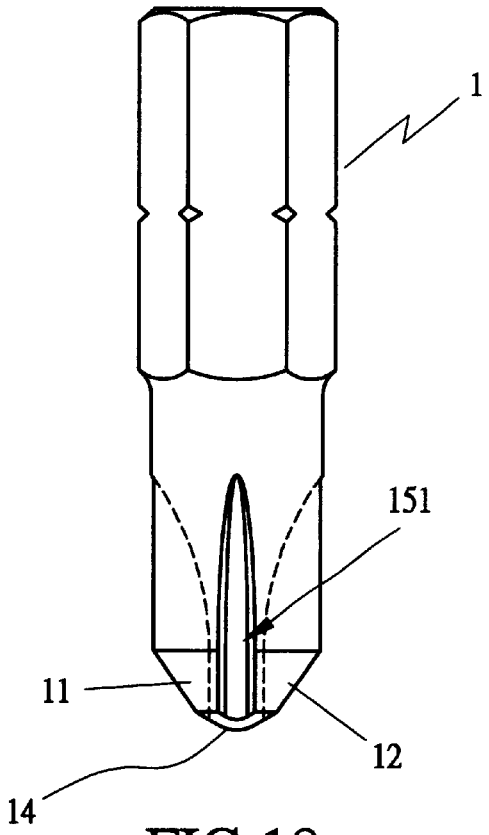
FIG. 18 is a side view similar to FIG. 16.
Figure 17:
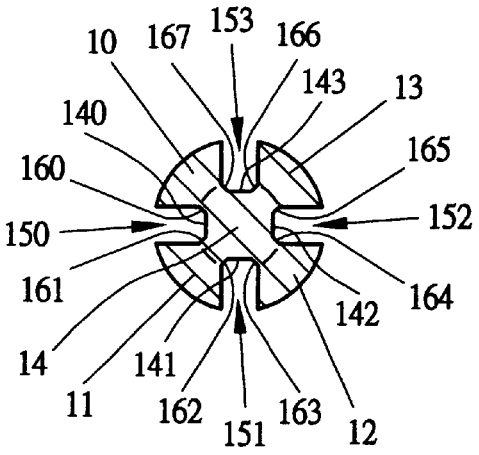
FIG. 17 is a cross-sectional view of the line 17—17 in FIG. 16.
Figure 19:
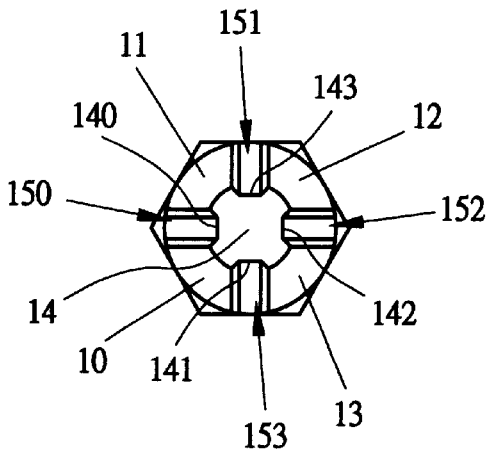
FIG. 19 is a bottom view of FIG. 18.
Figure 20:
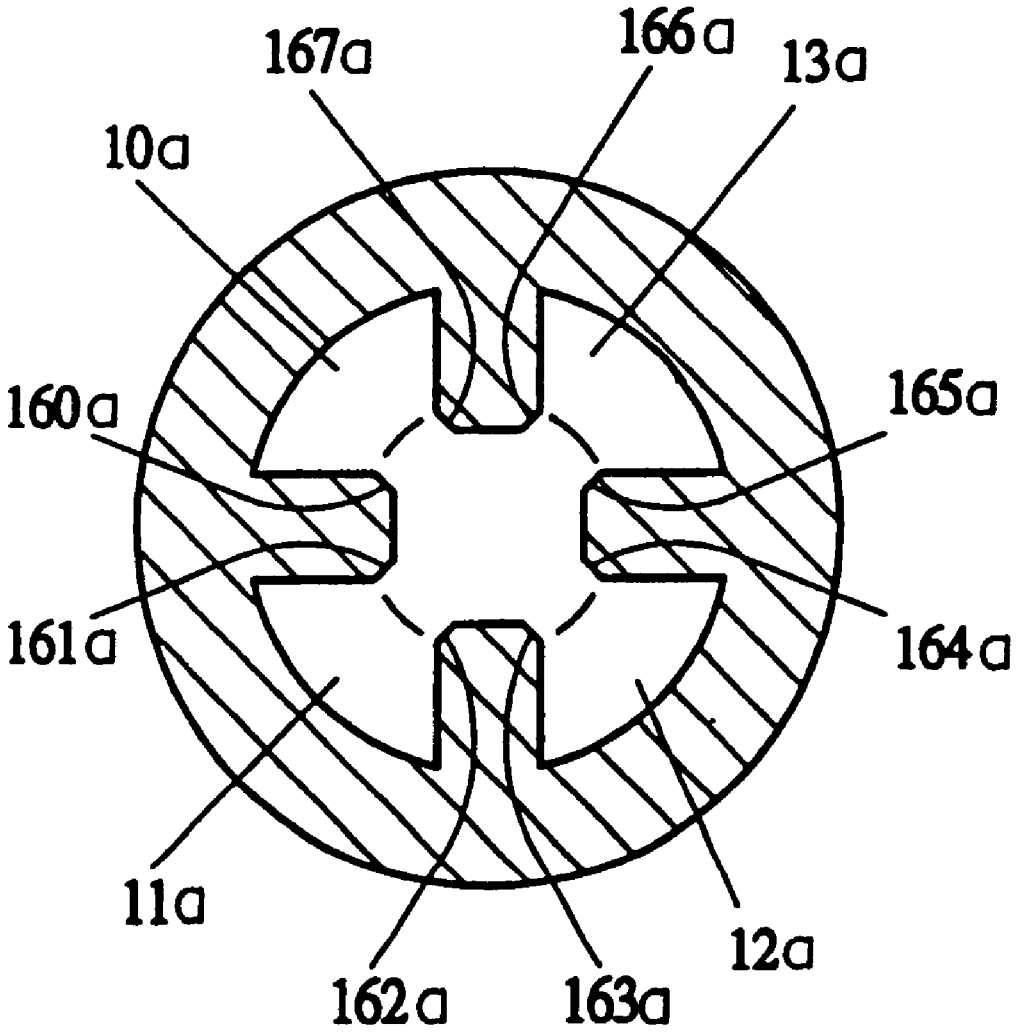
FIG. 20 is a compound drive recess, whereby a screw can be driven by various conventional drivers, e.g. slot, Phillips (cross), square-cross, square, and double-cross.

FIG. 16 shows the preferred embodiment of the specific screw driver for the aforementioned compound drive recess (FIG. 20.) This screw drive bit includes a shank (or body) 1. The free end of the shank 1 is provided with four fan-shaped blades 10, 11, 12,13 symmetrically disposed with respect to each other (the four fan-shaped blades' 10, 11, 12, 13 positional relationship is shown as in FIG. 17 and FIG. 19), and a square blunt portion 14 is formed in the common lower center section joining the four fan-shaped blades 10, 11, 12, and 13 (also as the center square protrusion 14 in FIG. 17 and FIG. 19). The cross-sectional view of FIG. 16 along through line 17—17 is shown in FIG. 17 showing the square portion 14 with four side walls 140, 141, 142, and 143. Four elongated rectangular hollow spaces 150, 151, 152, 153 are respectively formed between every two neighboring fan-shaped blades 10,11,12 and 13. Eight chamfered edges 160, 161, 162, 163, 164, 165, 166 and 167 are located at the corner connecting section of the center square protrusion and each of the four fan-shaped blades.

FIG. 20 is a planar view of the specialized screw for use with the inventive screw driver. The head of the screw includes recesses for receiving the driver. The recesses include chamfered edges 160*a*, 161*a*, 162*a*, 163*a*, 164*a*, 165*a*, 166*a*, 167*a* that face against the chamfered edges 160–167 of the driver respectively, and recesses 10*a*, 11*a*, 12*a*, 13*a* for receiving the fan-shaped blades or portions 10–14 of the driver.

While the preferred embodiment of the invention has been described above, it will be recognized and understood that various modifications may be made therein and the appended claims are intended to cover all such modifications that may fall within the spirit and scope of this invention.

What is claimed is:

1. A screw driver for a screw having recesses adapted to receive and be driven by a square type driver, cross-recess type driver and a flat-blade type driver, the screw driver comprising:

a shank portion;

a square blunt portion extending from the shank portion, the square blunt portion comprising a first pair of vertical walls parallel to one another, a second pair of vertical walls parallel to one another, and four corners, the first and second vertical walls perpendicular to one another, each adjacent ones of the vertical walls separated by one of the four corners; and four fan-shaped portions, each one of the fan-shaped portions radially extending outwardly from a corresponding one of the four corners of the square blunt portion, and each of the four fan-shaped portions having a pair of sidewalls radially extending from a respective one of the four corners of the square blunt portion such that sidewalls of the fan-shaped portions are either parallel or perpendicular with the vertical walls of the square blunt portion.

2. The screw driver as claimed in claim 1, wherein ends of the vertical walls are chamfered, such that eight chamfers are formed between the vertical walls and the fan-shaped portions.

* * * * *